US009352889B2

(12) United States Patent
Giraud et al.

(10) Patent No.: US 9,352,889 B2
(45) Date of Patent: May 31, 2016

(54) DISPENSER

(71) Applicants: Jean-Pierre Giraud, Auburn, AL (US); Herve Pichot, Chennevieres-sur-Marne (FR)

(72) Inventors: Jean-Pierre Giraud, Auburn, AL (US); Herve Pichot, Chennevieres-sur-Marne (FR)

(73) Assignee: CSP Technologies, Inc., Auburn, AL (US)

( * ) Notice: Subject to any disclaimer, the term of this patent is extended or adjusted under 35 U.S.C. 154(b) by 0 days.

(21) Appl. No.: 14/385,930

(22) PCT Filed: Mar. 19, 2013

(86) PCT No.: PCT/US2013/032939
§ 371 (c)(1),
(2) Date: Sep. 17, 2014

(87) PCT Pub. No.: WO2013/142479
PCT Pub. Date: Sep. 26, 2013

(65) Prior Publication Data

US 2015/0048088 A1 Feb. 19, 2015

Related U.S. Application Data

(60) Provisional application No. 61/613,180, filed on Mar. 20, 2012, provisional application No. 61/617,378, filed on Mar. 29, 2012.

(51) Int. Cl.
*B65D 55/02* (2006.01)
*B65D 43/16* (2006.01)
(Continued)

(52) U.S. Cl.
CPC ..... *B65D 55/02* (2013.01); *B65D 43/16* (2013.01); *B65D 43/22* (2013.01); *B65D 47/08* (2013.01); *B65D 83/049* (2013.01); *B65D 83/0427* (2013.01); *B65D 2251/1058* (2013.01); *B65D 2251/1066* (2013.01)

(58) Field of Classification Search
CPC .... B65D 55/02; B65D 43/16; B65D 2215/04; B65D 2251/1058; B65D 2251/1066; B65D 43/22; B65D 83/0427; B65D 83/049; B65D 47/08; Y10S 292/11; Y10S 292/37; Y10T 292/1022; Y10T 292/1023
See application file for complete search history.

(56) References Cited

U.S. PATENT DOCUMENTS 4,126,224 A 11/1978 Laauwe et al.
4,260,067 A 4/1981 Andruchiw
(Continued)

FOREIGN PATENT DOCUMENTS

EP 1582476 A1 10/2005
GB 2082552 A 3/1982
(Continued)

*Primary Examiner* — Andrew Perreault
(74) *Attorney, Agent, or Firm* — David B. Gornish

(57) ABSTRACT

A dispenser for dispensing product includes a dispenser body having a sidewall. The sidewall generally defines first and second interior sections. The first interior section is configured to house the product, and the second interior section is configured for dispensing of product. The dispenser further includes lid having a lip configured to engage the dispenser body when the dispenser is in a closed position to form a seal. The dispenser further includes a release mechanism having an activation portion and an engagement portion. At least a portion of the activation portion is positioned about an aperture in the sidewall. The engagement portion is positioned in the second interior portion between the sidewall and the lip when the lid is in a closed position.

10 Claims, 18 Drawing Sheets

(51) Int. Cl.

| | |
|---|---|
| ***B65D 83/04*** | (2006.01) |
| ***B65D 47/08*** | (2006.01) |
| ***B65D 43/22*** | (2006.01) |

(56) References Cited

U.S. PATENT DOCUMENTS

| | | | | | |
|---|---|---|---|---|---|
| 5,573,127 | A * | 11/1996 | Takahashi | B65D 474/0814 | 215/237 |
| 5,911,937 | A | 6/1999 | Hekal | | |
| 6,080,350 | A | 6/2000 | Hekal | | |
| 6,082,572 | A | 7/2000 | Galton-Fenzi et al. | | |
| 6,124,006 | A | 9/2000 | Hekal | | |
| 6,130,263 | A | 10/2000 | Hekal | | |
| 6,174,952 | B1 | 1/2001 | Hekal | | |
| 6,214,255 | B1 | 4/2001 | Hekal | | |
| 6,221,446 | B1 | 4/2001 | Hekal | | |
| 7,000,792 | B2 * | 2/2006 | Arai | B65D 43/22 | 215/237 |
| 7,213,720 | B2 | 5/2007 | Giraud | | |
| 7,537,137 | B2 | 5/2009 | Giraud | | |
| 8,528,778 | B2 | 9/2013 | Giraud | | |
| 2006/0096984 | A1 | 5/2006 | Bandoh et al. | | |
| 2006/0151416 | A1 * | 7/2006 | Hennemann | B65D 47/0828 | 215/235 |
| 2007/0228042 | A1 | 10/2007 | Yeager | | |
| 2008/0100068 | A1 * | 5/2008 | Kim | B60N 3/083 | 292/163 |

FOREIGN PATENT DOCUMENTS

| | | | |
|---|---|---|---|
| GB | 2166423 | A | 5/1986 |
| GB | 2449505 | A | 11/2008 |
| JP | H09 315455 | A | 12/1997 |

* cited by examiner 152
136
104
118
112
144
132
116
138
126
134
148
108
120
140
110
100
122
128
102
114
106
130
156

152
132
144
116
112
136
138
126
134
148
108
120
104
140
100
128
130
114
102
110
106
156

222
204
212
210
208
200
202
256

216
246
244
238
208
214
212
236
224
204
222
202
200
218
210
256

244

250
250
208
242
242
248
240
240
238

DISPENSER

CROSS REFERENCE TO RELATED APPLICATIONS

This application is a U.S. National Phase Application of International Application No. PCT/US2013/032939, filed Mar. 19, 2013 which claims priority from U.S. Provisional Application Ser. No. 61/613,180, filed Mar. 20, 2012; and 61/617,378, filed Mar. 29, 2012.

BACKGROUND OF THE INVENTION

The present invention relates to a dispenser to contain products including pharmaceutical dosage forms, tobacco products, or confectionaries.

Product packaging enhances a product with many additional features such as environmental protection and protection from being damaged. Many products are packaged in multiple unit packages or bulk for consumer convenience and packaging efficiency. Typically the entire product is exposed when the package is opened. If the product needs to be protected from the environment, for example humidity, then a seal is required.

One way to ensure the product is protected is to provide a seal for the entire contents of the package. This type of approach may impose certain dimensional, shape or other design constraints on the package design. In this approach, all of the product may be exposed to the consumer or child who opens the package. Some means would be needed to restrain the product so that it is held in place so that it is easy to access but does not fall out of the package.

Another way is to protect the product in a protective envelope or wrapper. When this wrapper is opened, the entire product is exposed. Again, the entire product is exposed to the environment and it is no longer protected. In addition, the entire remaining product is exposed to children.

Depending on the requirements of the package, the design may become complicated with several contradictory constraints that would need to be managed in order to meet the requirements. This could lead to added expense and an undesirable package for the consumer.

BRIEF SUMMARY OF THE INVENTION

An aspect of the invention is a dispenser for the dispensing of product. The dispenser includes a dispenser body having a sidewall. The sidewall generally defines a first interior section and a second interior section. The first interior section is configured to house the product, and the second interior section is configured for the dispensing of the product. The second interior section has an inner channel and an opening. The dispenser further includes lid having a lip configured to engage the dispenser body when the dispenser is in a closed position to form a seal. The dispenser further includes a release mechanism having an activation portion and an engagement portion. At least a portion of the activation portion is positioned about an aperture in the sidewall. The engagement portion is positioned in the second interior portion between the sidewall and the lip when the lid is in a closed position.

Another aspect of the present invention is a dispenser for the dispensing of products. The dispenser includes a dispenser body having a sidewall. The sidewall generally defines an interior section and an opening. The interior section is configured to house the product, and the opening configured for the dispensing of the product. The dispenser further includes a lid having an inner lip configured to engage the dispenser body when the dispenser is in a closed position to form a seal, and an outer lip positioned outward of the inner lip. The dispenser further includes a release mechanism having an activation portion and an engagement portion. At least a portion of the activation portion is positioned about an aperture in the sidewall of the dispenser body. The engagement portion is positioned between the inner lip and the outer lip when the lid is in a closed position.

Figure 1:
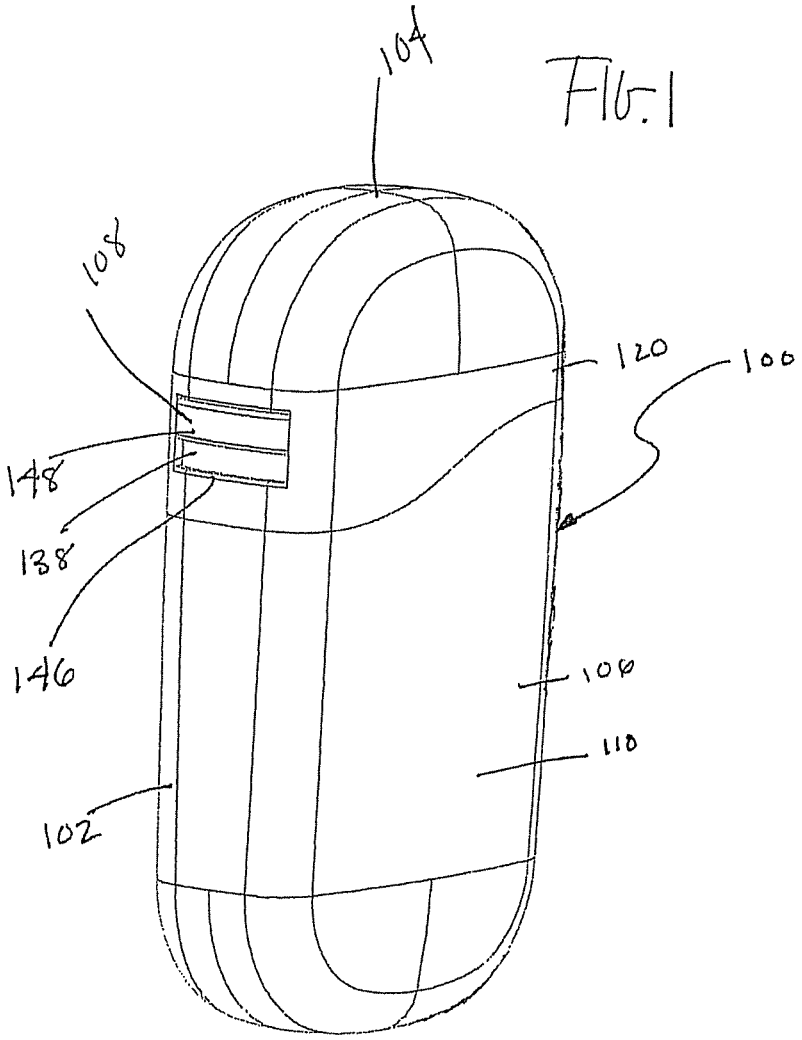
FIG. 1 illustrates a front perspective view of a first embodiment of a dispenser with the lid in a closed position according to an embodiment of the present invention.

| | |
|---|---|
| 100 | Dispenser |
| 102 | Sidewall |
| 104 | Lid |
| 106 | Bottom piece |
| 108 | Release mechanism |
| 110 | Dispenser body |
| 112 | Hinge |
| 114 | First interior section |
| 116 | Second interior section |
| 118 | Product |
| 120 | Top piece |
| 122 | Inlet |
| 126 | Inner channel |
| 128 | Bottom piece shoulder |
| 130 | Top piece shoulder |
| 132 | Front portion |

-continued

| | |
|---|---|
| 134 | Back portion |
| 136 | Lip |
| 138 | Activation portion |
| 140 | Spring |
| 142 | Sides |
| 144 | Engagement portion |
| 146 | Aperture |
| 148 | Tab |
| 150 | Slots |
| 152 | Backside |
| 156 | Base |
| 200 | Dispenser |
| 202 | Sidewall |
| 204 | Lid |
| 208 | Release mechanism |
| 210 | Dispenser body |
| 212 | Hinge |
| 214 | Interior section |
| 216 | Opening |
| 218 | Product |
| 222 | Outer wall of lid |
| 224 | Outer lip |
| 236 | Inner lip |
| 238 | Activation portion |
| 240 | Springs |
| 242 | Sides |
| 244 | Engagement portion |
| 246 | Aperture |
| 248 | Tab |
| 250 | Slots |
| 256 | Base |

DETAILED DESCRIPTION OF THE INVENTION

The present invention will now be described more fully with reference to the accompanying drawings, in which several embodiments are shown. The invention may, however, be embodied in many different forms and should not be construed as limited to the embodiments set forth here. Rather, these embodiments are examples of the invention, which has the full scope indicated by the language of the claims. Further, certain terminology is used in the foregoing description for convenience and is not intended to be limiting, including, for example, words such as "front," "back," and "bottom," which designate directions in the drawings to which reference is made. This terminology includes the words specifically noted above, derivatives thereof, and words of similar import Like numbers refer to like elements throughout.

Figure 2:
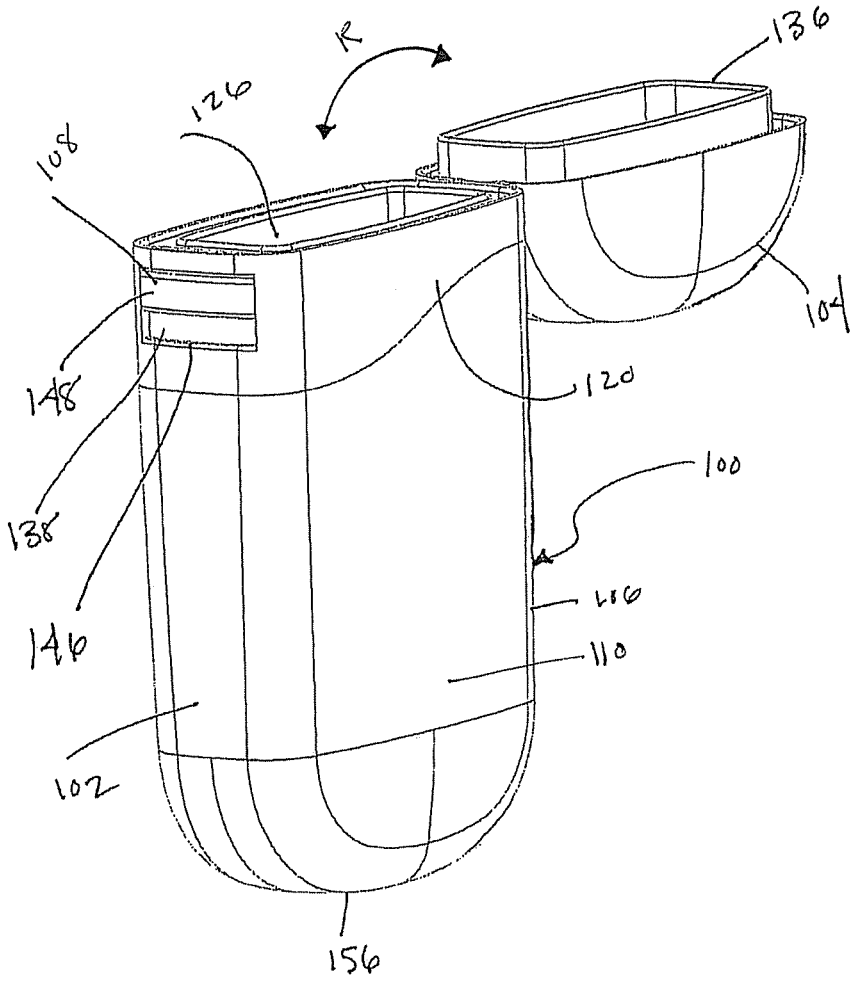
FIG. 2 illustrates a front perspective view of the dispenser shown in FIG. 1 with the lid in an opened position.
Figure 3:
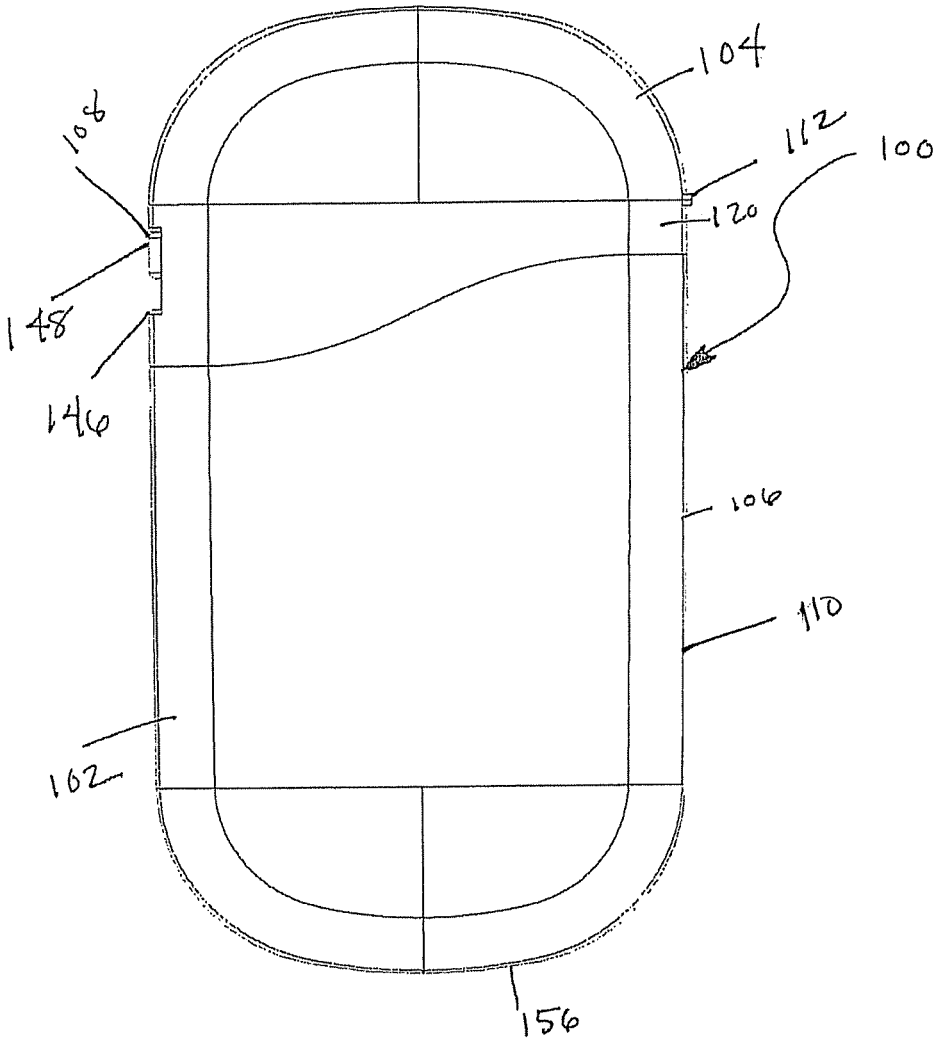
FIG. 3 illustrates a side view of the dispenser shown in FIG. 1.
Figure 4:
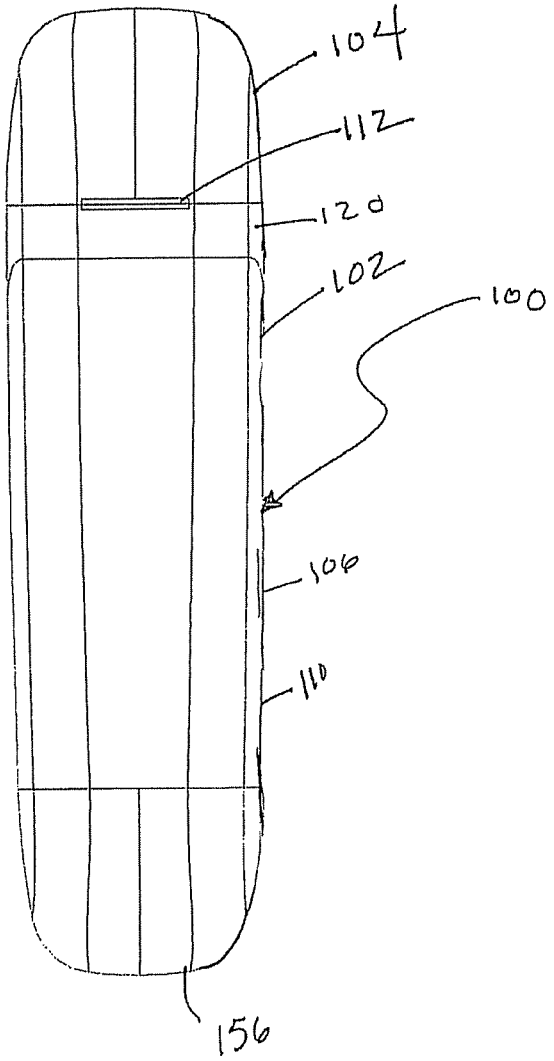
FIG. 4 illustrates a rear view of the dispenser illustrated in FIG. 1.

FIGS. 1-6 illustrate a first embodiment of a dispenser 100 according to the present invention. As shown, the dispenser 100 includes a dispenser body 110, a lid 104 and a release mechanism 108. According to certain embodiments, the lid 104 may be attached to the dispenser body 110 by a hinge 112 that allows a user to pivot the lid 104 in direction R from a closed position, as shown in FIG. 1, to an open position, as shown in FIG. 2. According to certain embodiments, the dispenser body 110, lid 104, and hinge 112 may all be integrally molded together. According to other embodiments, the dispenser body 110, hinge 112, and lid 104 may be separate components that are operably connected to each other via the hinge 112. For example, the hinge 112 may be secured to the dispenser body 110 and the lid 104 through the use of a plastic weld, adhesive, or mechanical fastener, such as a screw or rivet, among others. According to other embodiments, the lid 104 may not be directly or indirectly attached to the dispenser body 110 so that the lid 104 may be removed and separated from the dispenser body 110.

The dispenser body 110 has a sidewall 102 that generally defines a first interior section 114 and a second interior section 116. The first interior section 114 is configured to store or house a product(s) 118, while the second interior section 116 is configured for the dispensing of product 118 that is housed in the dispenser 100.

According to certain embodiments, the dispenser body 110 is formed as two pieces, including a bottom piece 106 that substantially forms the first interior section 114, and a top piece 120 that substantially forms the second interior section 116. The bottom piece 106 may be removable from the top piece 120 to permit, for example, placement of product within the first interior section 114 or cleaning of the dispenser 100. The bottom piece 106 and top piece 120 can be joined by any suitable means of forming a connection known in the art. In the illustrated embodiment, the bottom piece 106 and top piece 120 include interlocking shoulders 128, 130 that form a frictional engagement. Other suitable means of connecting the top piece 120 with the bottom piece 103 include a threaded connection, mechanical fasteners, and a snapping engagement.

Figure 5:
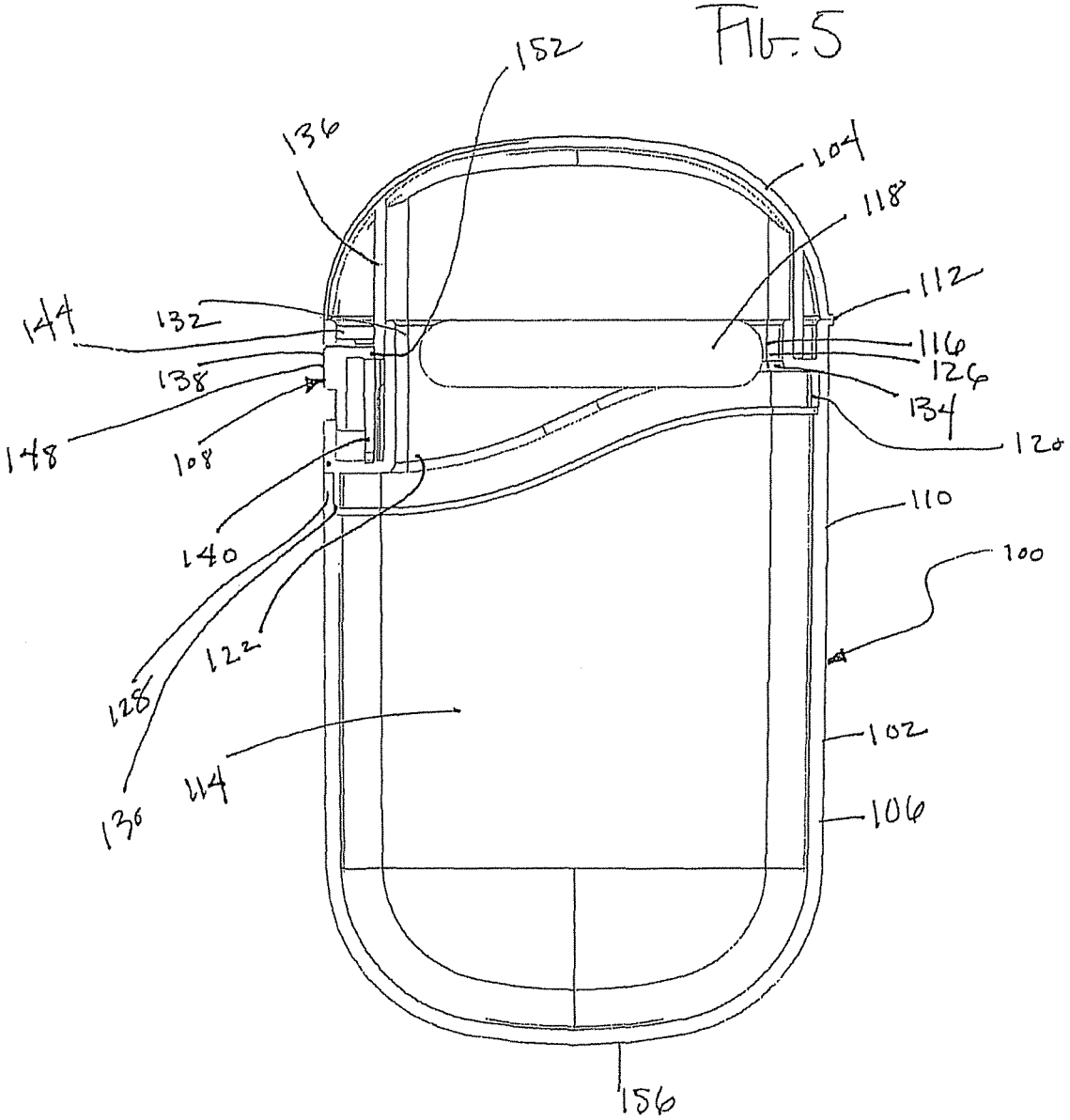
FIG. 5 illustrates a side cross sectional view of the dispenser illustrated in FIG. 1.
Figure 6:
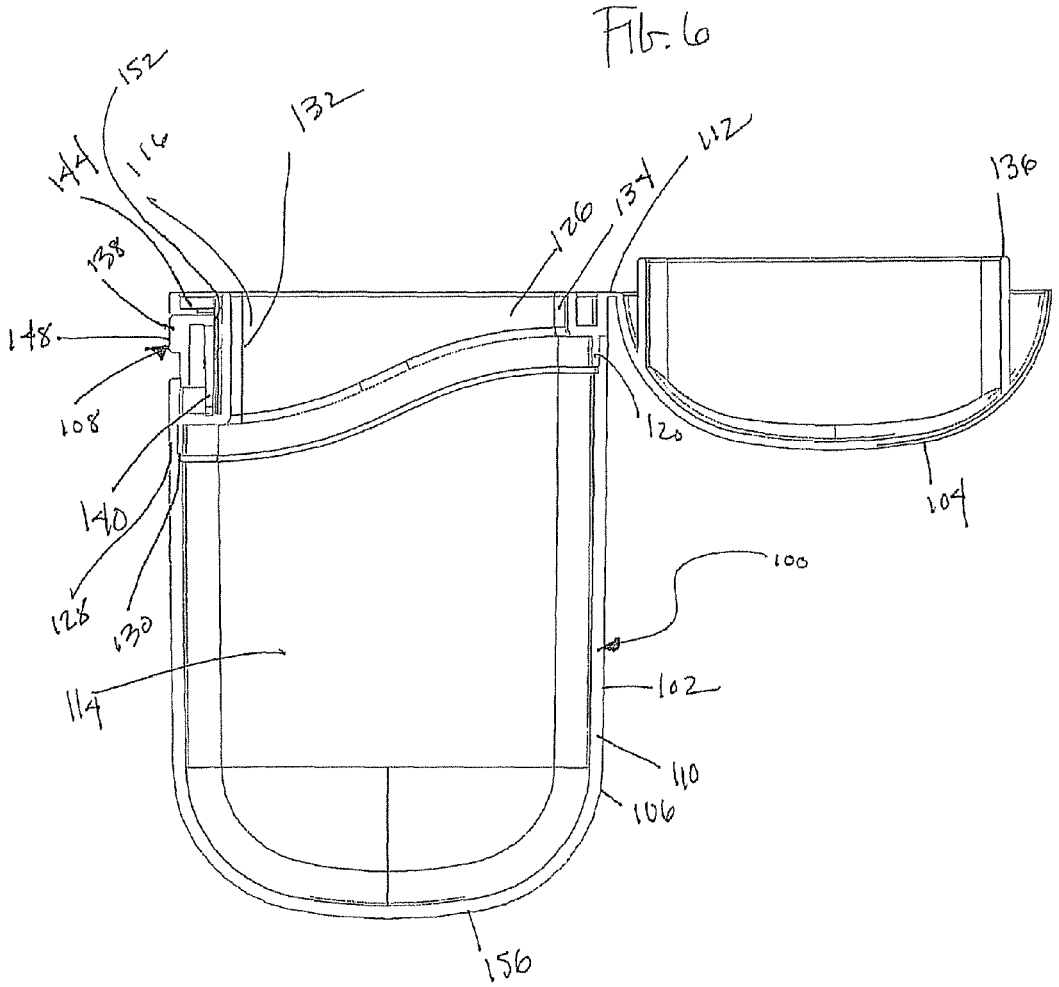
FIG. 6 illustrates a side cross sectional view of the dispenser shown in FIG. 2.

As shown in at least FIGS. 2, 5 and 6, the second interior section 116 includes an inner channel 126 that extends from the inlet 122 to the second interior section 116. When product 118 is to be dispensed from the dispenser 100, the dispenser 100 may be positioned, twisted, or shaken so that the product 118 is able to move from the first interior section 114 into the inner channel 126 of the second interior section 116.

According to certain embodiments, the inner channel 126 may be inwardly offset from the adjacent portion of the sidewall 102. Further, the distance that the inner channel 126 is offset from the sidewall 102 may be different across different portions of the second interior section 116. For example, as shown in FIG. 5, the front portion 132 of the inner channel 126 may be spaced further away from the adjacent portion of the sidewall 102 than a back portion 134 of the inner channel 126 is spaced away from its adjacent portion of the sidewall 102. According to certain embodiments, such spacing may be configured to provide an area for other components of the dispenser 100, such as the release mechanism 108.

The dispenser 100 also includes a lip seal arrangement to isolate at least a portion of the interior sections 114, 116 of the dispenser 100 from the exterior environment when the dispenser 100 is closed. According to the illustrated embodiment, the lip seal is provided by a closed lip 136 of the lid 104 engaging and/or abutting an upper region of the inner channel 126 when the lid 104 is in a closed position, as shown in FIG. 5. According to an embodiment, the lip 136 and/or upper region of the inner channel 126 may be configured to bend, deform, or deflect when the lip 136 engages the inner channel 126 so that the mating engagement of the lip 136 and inner channel 126 provide the desired seal. Such an engagement may also at least assist in maintaining the lid 104 in a closed position.

Figure 7:
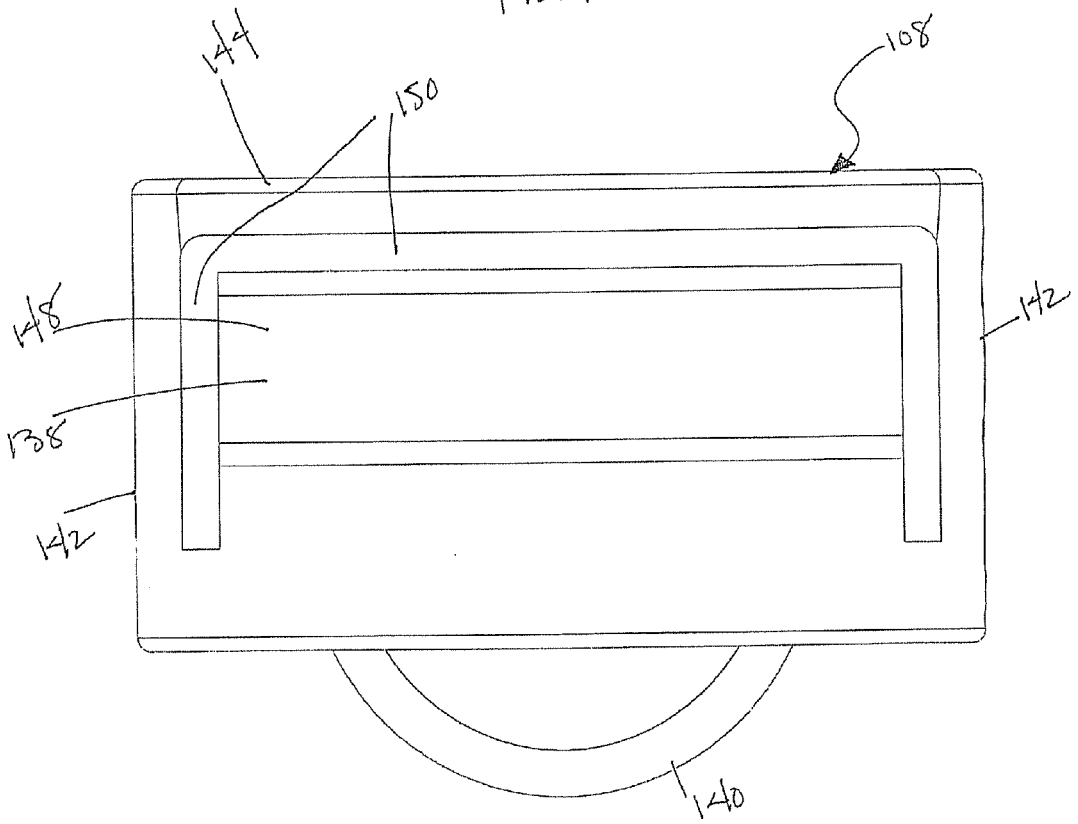
FIG. 7 illustrates a front view of a release mechanism according to an embodiment of the present invention.
Figure 8:
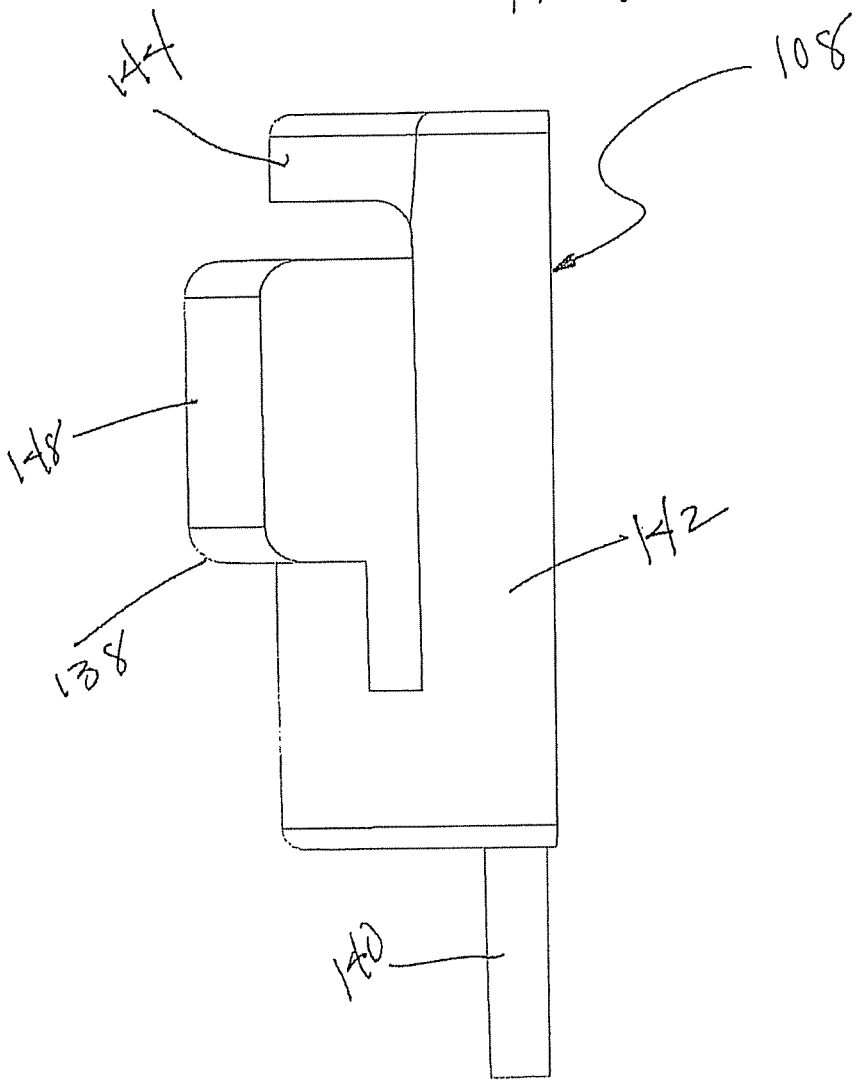
FIG. 8 illustrates a side view of the release mechanism shown in FIG. 7.
Figure 9:
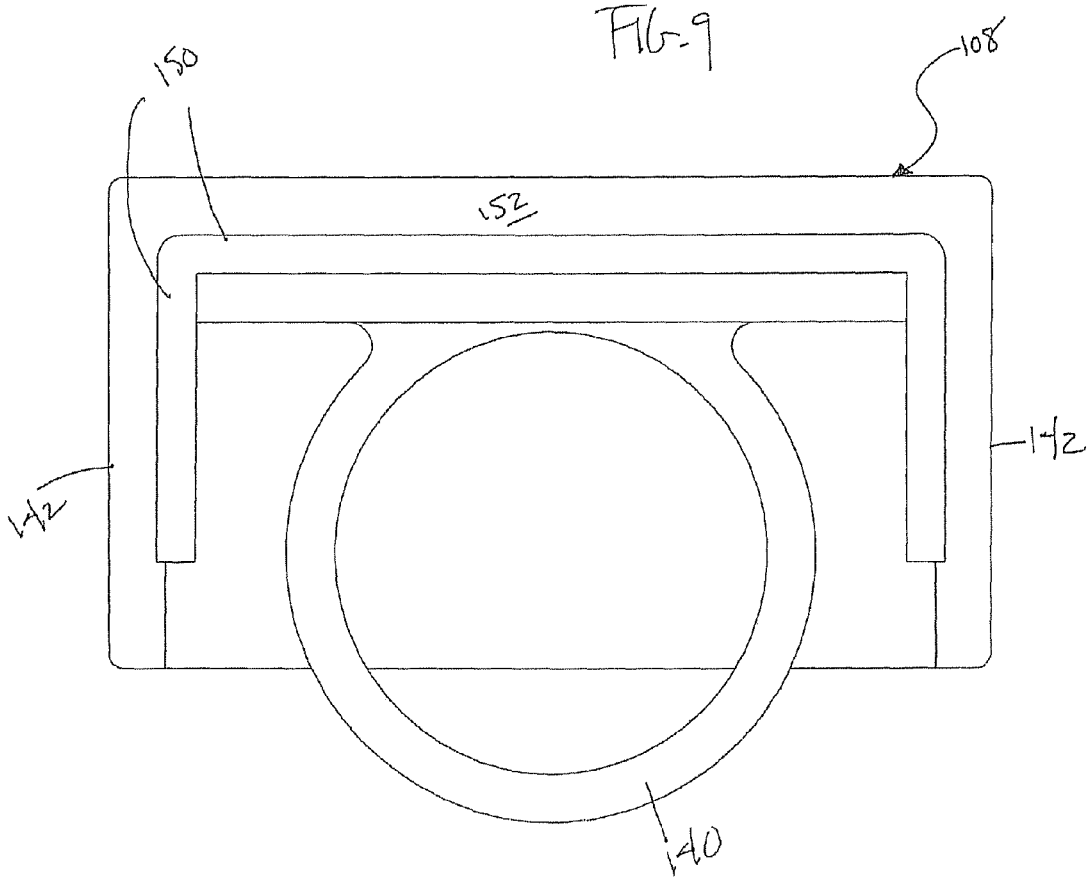
FIG. 9 illustrates a rear view of the release mechanism shown in FIG. 7.

FIGS. 7-9 illustrate the release mechanism 108 according to an embodiment of the present invention. The illustrated release mechanism 108 includes an activation portion 138, spring 140, sides 142, and an engagement portion 144, located at an upper region of the release mechanism 108. As shown in FIGS. 5 and 6, at least a portion of the release mechanism 108 is positioned between the inner channel 126 and the sidewall 102 of the dispenser 100. As also shown, the activation portion 138 may be accessible to a user through an aperture 146 in a sidewall 102 of the dispenser 100. According to the illustrated embodiment, the activation portion 138 includes an outwardly extending tab 148 that facilitates the ability of a user to engage the activation portion 138. The activation portion 138 may be separated from the sides 142 and engagement portion 144 of the release mechanism 108 by slots 150. The sides 142 and engagement portion 144 of the release mechanism 108 may extend along at least a portion of an interior region of the sidewall 102. As shown in FIG. 5, when the lid 104 is in a closed position, the release mechanism 108 is in a first position, in which opposing surfaces of the sides 142 and engagement portion 144 of the release mechanism 108 may engage at least a portion of the lip 136 of the lid 104. According to certain embodiments, such an engagement may assist in pressing on the adjacent portion of the lip 136 to at least assist in forming the desired seal with the inner channel 126. Additionally, such an engagement of the engagement portion 144 and/or sides 142 of the release mechanism 108 may also assist in retaining the lid 104 in a closed position. Further, in view of such a configuration, according to certain embodiments, when the dispenser 100 is opened, there may be a space between the inner channel 126 and the engagement portion 144 and sides 142 that is configured to receive the placement of at least a portion of the lip 136.

According to one embodiment, when the dispenser 100 is to be opened, the user may generally slide activation portion 138 downward, or toward the base 156 of the dispenser 100 so as to lower the release mechanism 108, and more particularly the engagement portion 144 of the release mechanism 108, in the dispenser 100 to a second position. According to such an embodiment, when in the second position, the engagement portion 144 may be displaced so as to not interfere with the ability of the lip 136 to be moved between the closed and opened positions, and vice versa. When the user releases the activation portion 138, the spring 140 may bias the release mechanism 108 generally back to the first position.

When the lid 104 for an open dispenser 100 is to be closed, the user may again engage the release mechanism 108 in a manner similar to that used for opening a closed dispenser 100 by downwardly manipulating the release mechanism 108 to the second position. When the lid 104 is in the closed position, the user may release the activation portion 138, thereby allowing the release mechanism 108 to return to the first position, where the engagement portion 144 is pressed against at least a portion of the lip 136. As discussed above, according to certain embodiments, at least a portion of the engagement portion 144 and the sides 142 of the release mechanism 108 may be separated from the inner channel 126 by a gap that is configured for receiving at least a portion of the lip 136.

Figure 10:
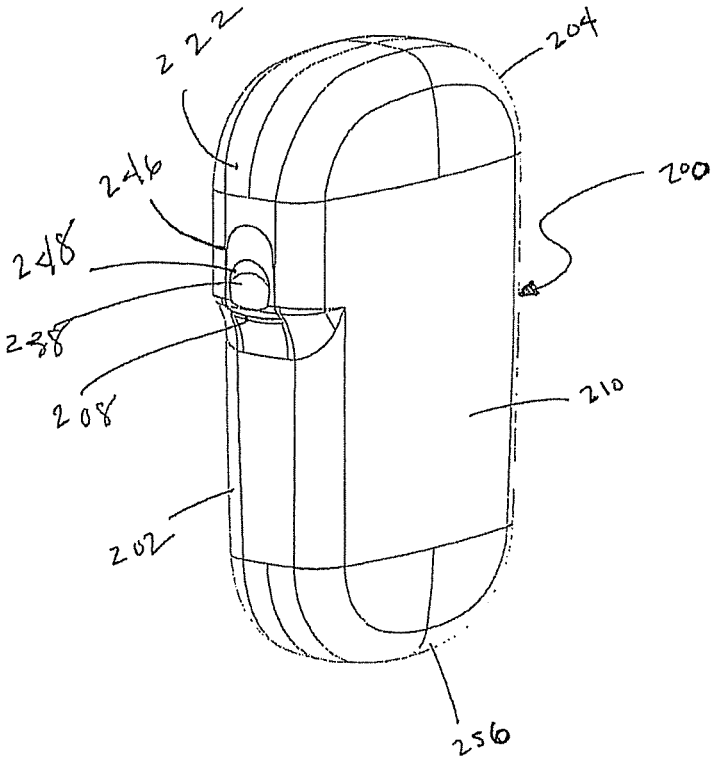
FIG. 10 illustrates a front perspective view of a second embodiment of a dispenser with the lid in a closed position according to an embodiment of the present invention.
Figure 11:
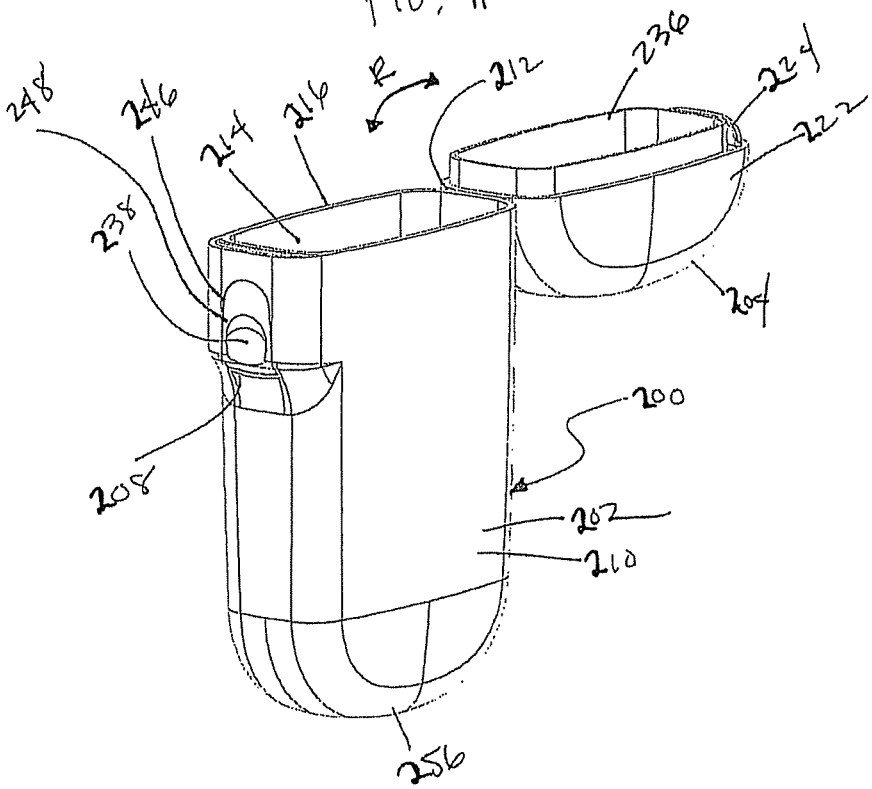
FIG. 11 illustrates a front perspective view of the dispenser shown in FIG. 10 with the lid in an opened position.
Figure 12:
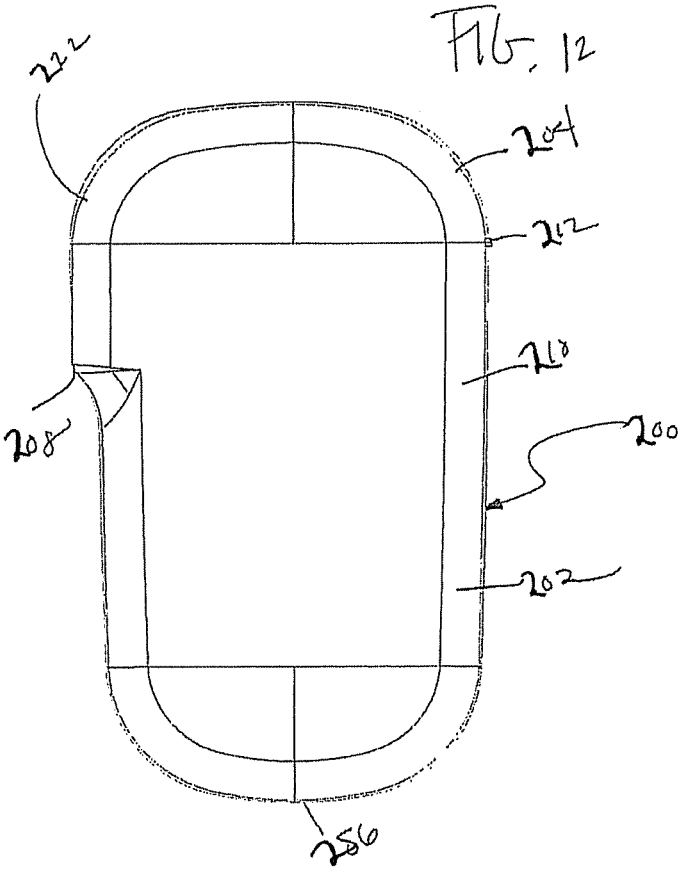
FIG. 12 illustrates a side view of the dispenser shown in FIG. 10.
Figure 13:
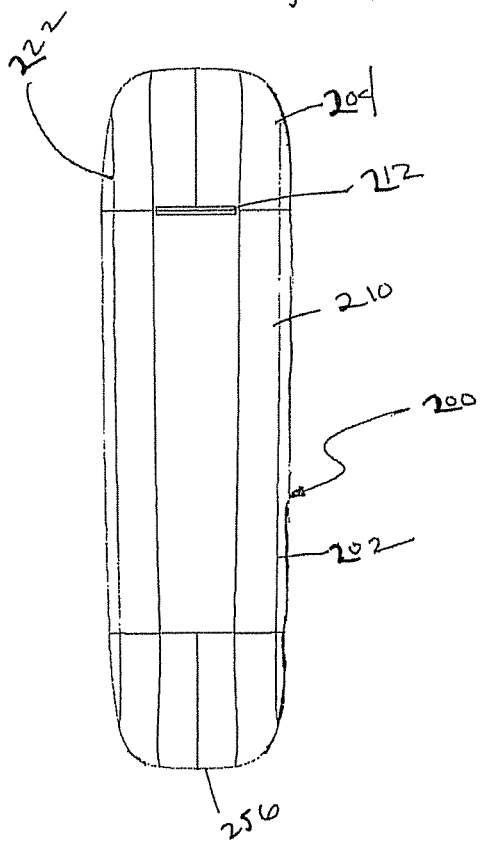
FIG. 13 illustrates a rear view of the dispenser illustrated in FIG. 10.
Figure 14:
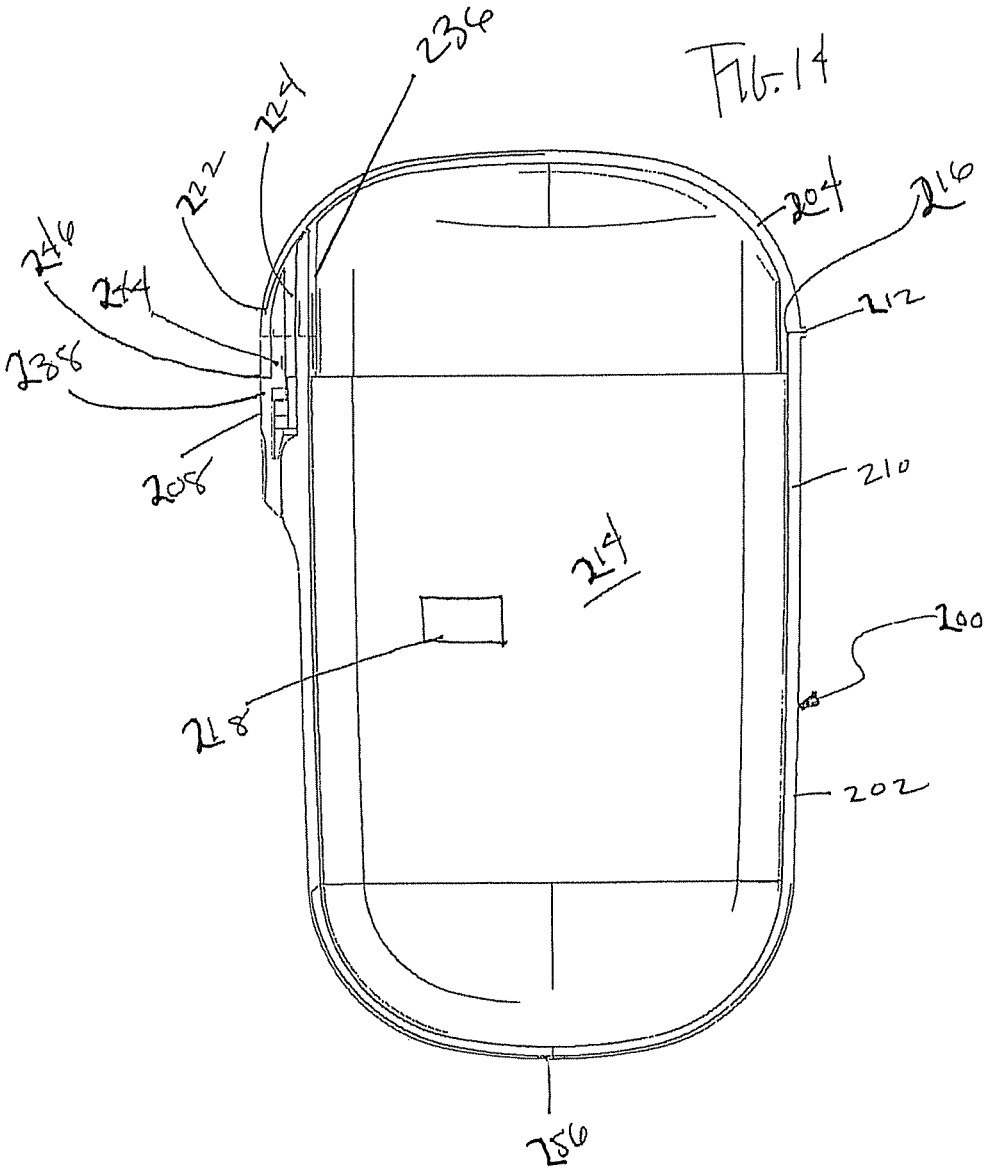
FIG. 14 illustrates a side cross sectional view of the dispenser illustrated in FIG. 10.
Figure 15:
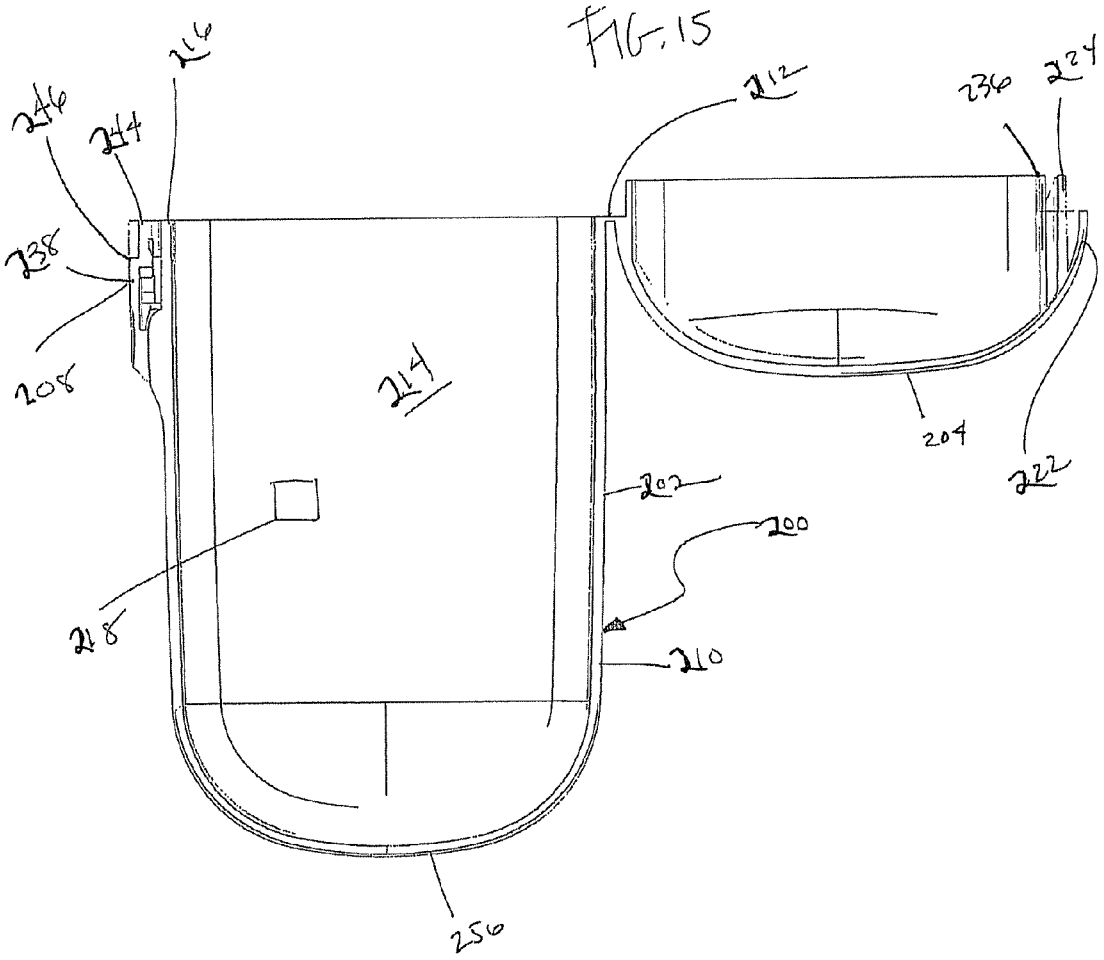
FIG. 15 illustrates a side cross sectional view of the dispenser shown in FIG. 11.

FIGS. 10-15 illustrate a second embodiment of a dispenser 200 according the present invention. As shown, the dispenser 200 includes a dispenser body 210, a lid 204 and a release mechanism 208. According to certain embodiments, the lid 204 may be attached to the dispenser body 210 by a hinge 212 that allows a user to pivot the lid 204 in direction R from a closed position, as shown in FIG. 10, to an open position, as shown in FIG. 11. According to certain embodiments, the dispenser body 210, lid 204, and hinge 212 may all be integrally molded together. According to other embodiments, the dispenser body 210 and lid 204 may be separate components that are operably connected to each other via the hinge 212. For example, the hinge 212 may be secured to the dispenser body 210 and the lid 204 through the use of a plastic weld, adhesive, or mechanical fastener, such as a screw or rivet, among others. According to other embodiments, the lid 204 may not be directly or indirectly attached to the dispenser body 210 so that the lid 204 may be removed and separated from the dispenser body 210. As shown in FIGS. 14 and 15, the lid may include an outer lip 224, located inward with respect to lid outer wall 222, but outward with respect to inner lip 236, as described below. Outer lip 224 can extend completely around the inner perimeter of the lid 204, or as shown in the illustrated embodiment, just along the front thereof. Outer lip 224 facilitates engagement of release mechanism 208, as described below.

The dispenser body 210 has a sidewall 202 that generally defines an interior section 214 and an opening 216. The interior section 214 is configured to store or house a product(s) 218, and opening 216 leads to the interior section 214 and is configured for the dispensing of products 218 housed in the dispenser 200. The lid 204 covers the opening 216 when in the closed position of FIG. 10, and exposes the opening 216 for dispensing of products 218 when in the opened position of FIG. 11.

The dispenser 200 also includes a lip seal arrangement to isolate at least a portion of the interior section 214 of the dispenser 200 from the exterior environment when the dispenser 200 is closed. According to the illustrated embodiment, the lip seal is provided by a closed inner lip 236 of the lid 204 engaging and/or abutting an upper region of the side wall 202 defining the opening 216 when the lid 204 is in a closed position, as shown in FIG. 14. According to an embodiment, the inner lip 236 and/or upper region of the side wall 202 may be configured to bend, deform, or deflect when the inner lip 236 engages the side wall 202 so that the mating engagement of the inner lip 236 and side wall 202 provide the desired seal. Such an engagement may also at least assist in maintaining the lid 204 in a closed position.

Figure 16:
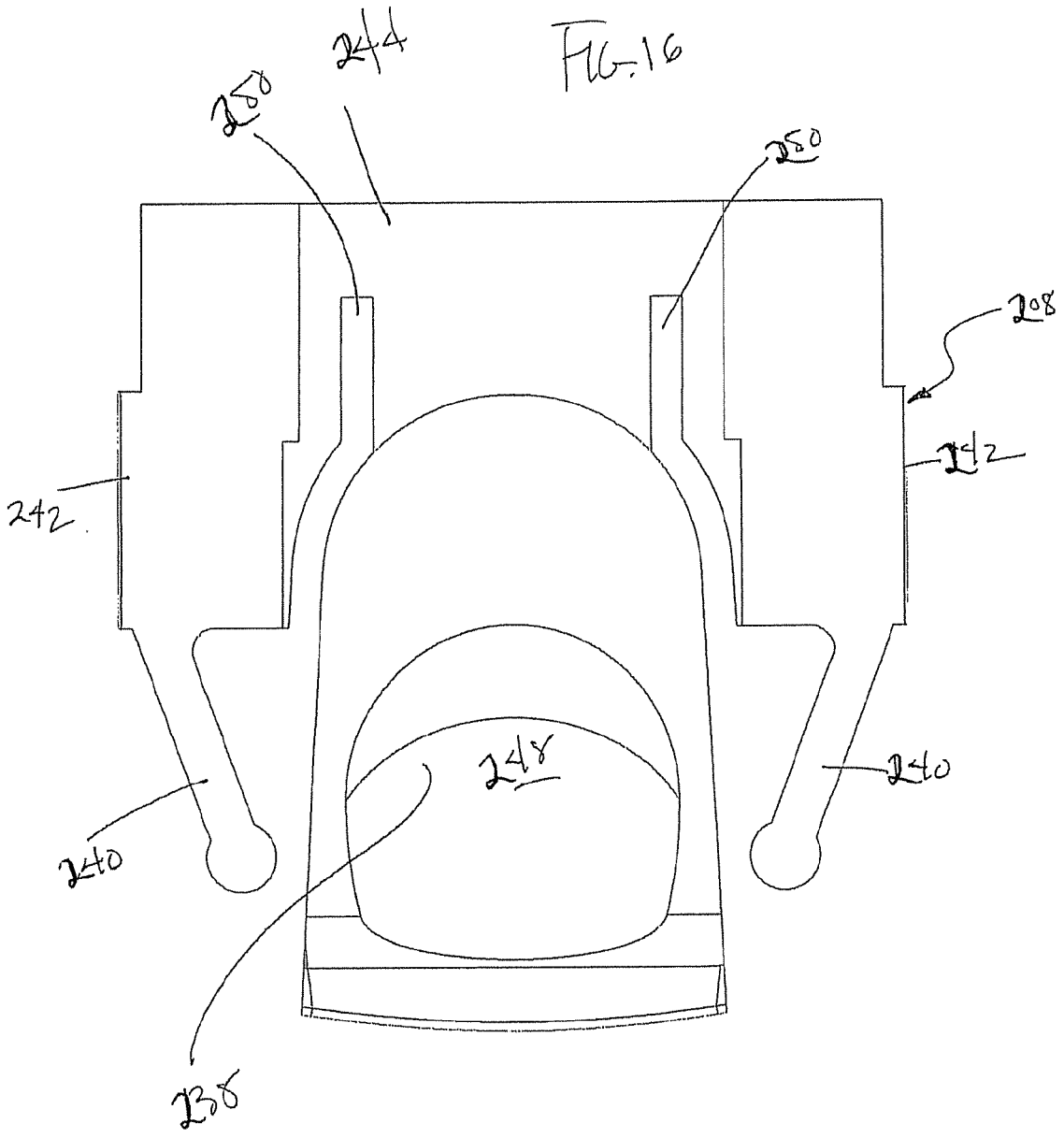
FIG. 16 illustrates a front view of a release mechanism according to an embodiment of the present invention.
Figure 17:
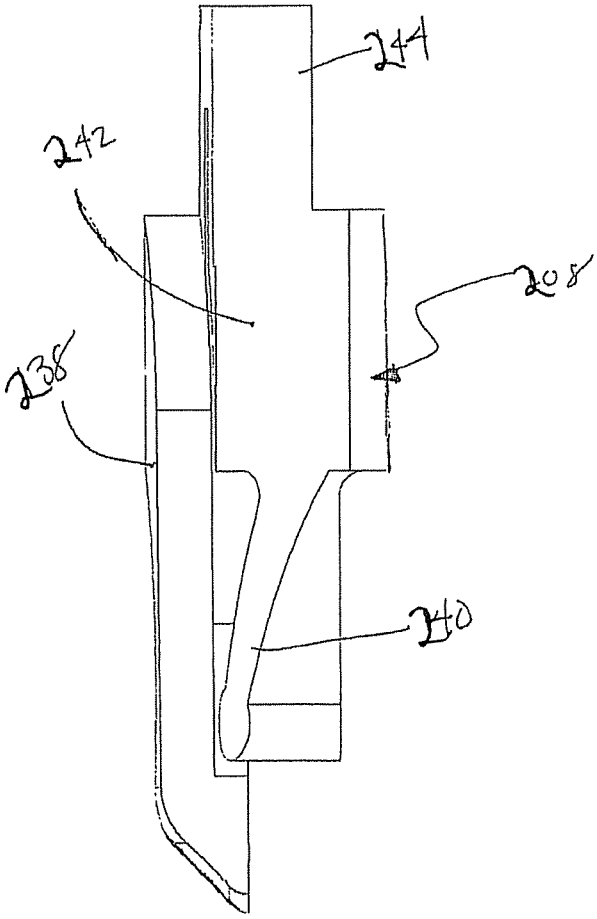
FIG. 17 illustrates a side view of the release mechanism shown in FIG. 16.
Figure 18:
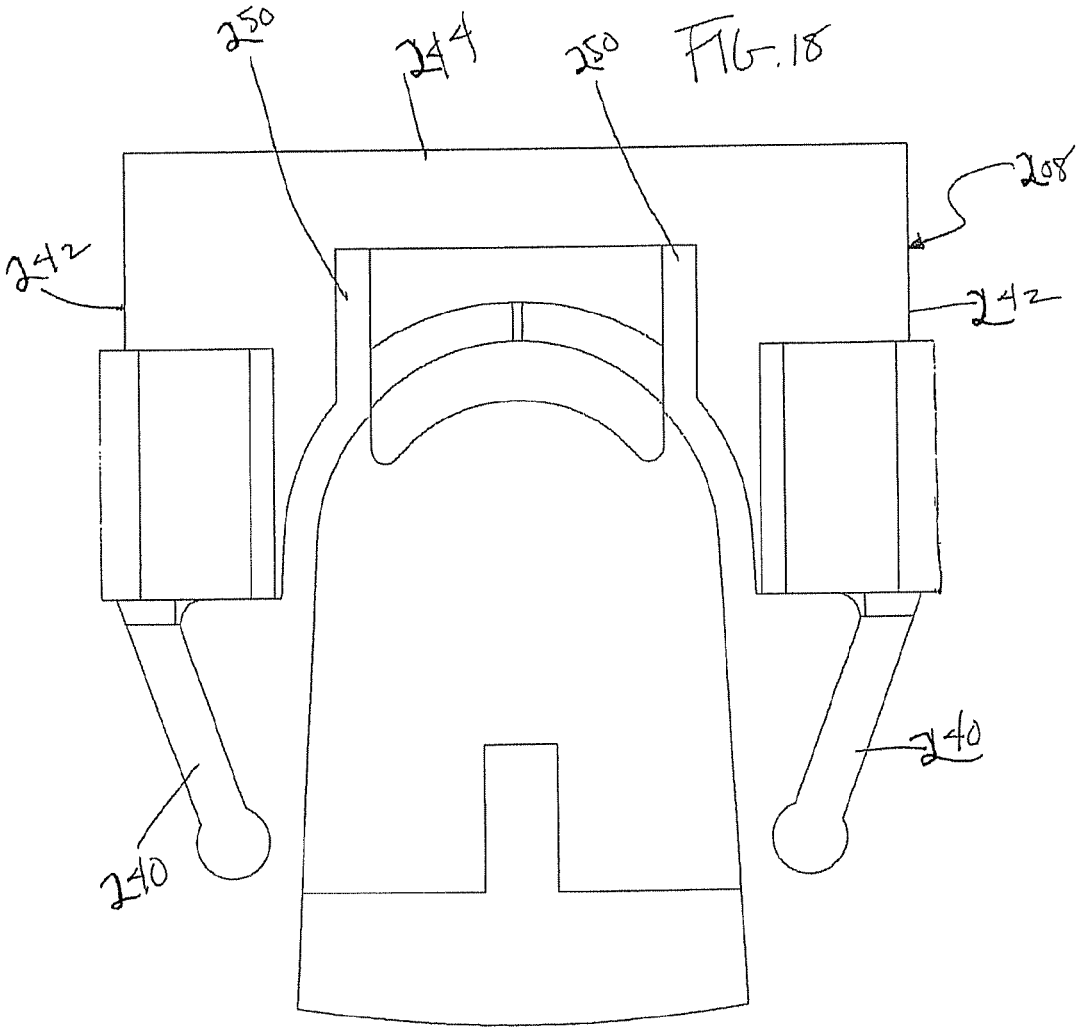
FIG. 18 illustrates a rear view of the release mechanism shown in FIG. 16.

FIGS. 16-18 illustrate the release mechanism 208 according to an embodiment of the present invention. The illustrated release mechanism 208 includes an activation portion 238, springs 240, sides 242, and an engagement portion 244, located at an upper area of the release mechanism 208. As shown in FIG. 14, when the lid 204 is in a closed position, at least a portion of the release mechanism 208 is positioned between the side wall 202 of the dispenser body and the lid 204, and between at least a portion of the outer wall 222 and outer lip 224 of the lid 204. As also shown, the activation portion 238 may be accessible to a user through an aperture 246 in the sidewall 202 of the dispenser body 214. The aperture 246 in the illustrated embodiment is formed as a cutout extending from a bottom edge of outer wall 222, but could also be completely closed off and formed in an inner region of outer wall 222.

According to the illustrated embodiment, the activation portion 238 includes an outwardly extending tab 248 that facilitates the ability of a user to engage the activation portion 238. The activation portion 238 may be separated from the sides 242 and engagement portion 244 of the release mechanism 208 by slots 250. The sides 242 and engagement portion 244 of the release mechanism 108 may extend along at least a portion of an exterior region of the sidewall 202. As shown in FIG. 14, when the lid 204 is in a closed position, the release mechanism 208 is in a first position, in which opposing surfaces of the sides 242 and engagement portion 244 of the release mechanism 208 may engage at least a portion of the outer lip 224 of the lid 204. According to certain embodiments, such an engagement may assist in pressing on the adjacent portion of the inner lip 236 to at least assist in forming the desired seal with the inner channel 226. Additionally, such an engagement of the engagement portion 244 and/or sides 242 of the release mechanism 208 may also assist in retaining the lid 204 in a closed position. Further, in view of such a configuration, according to certain embodiments, when the dispenser 200 is opened, there may be a space between the side wall 202 and the engagement portion 244 and sides 242 that is configured to receive the placement of at least a portion of the outer lip 224.

According to one embodiment, when the dispenser 200 is to be opened, the user may generally slide activation portion 238 downward, or toward the base 256 of the dispenser 200 so as to lower the release mechanism 208, and more particularly the engagement portion 244 of the release mechanism 208, in the dispenser 200 to a second position. According to such an embodiment, when in the second position, the engagement portion 244 may be displaced so as to not interfere with the ability of the outer lip 224 to be moved between the closed and opened positions, and vice versa. When the user releases the activation portion 238, the springs 240 may bias the release mechanism 208 generally back to the first position.

When the lid 204 for an open dispenser 200 is to be closed, the user may again engage the release mechanism 208 in a manner similar to that used for opening a closed dispenser 200 by downwardly manipulating the release mechanism 208 to the second position. When the lid 204 is in the closed position, the user may release the activation portion 238, thereby allowing the release mechanism 208 to return to the first position, where the engagement portion 244 is pressed against at least a portion of the inner lip 236. As discussed above, according to certain embodiments, at least a portion of the engagement portion 244 and the sides 242 of the release mechanism 208 may be separated from the side wall by a gap that is configured for receiving at least a portion of the outer lip 224.

While the preferred embodiments of the invention have been described in detail above, the invention is not limited to the specific embodiments described, which should be considered as merely exemplary.

The invention claimed is:

1. A dispenser for the dispensing of product comprising:

a dispenser body having a base, a sidewall extending from the base, the sidewall generally defining an interior section configured to house the product, and an opening, the opening leading to the interior section and configured for dispensing of product;

a lid having a lip configured to engage the dispenser body when the dispenser is in a closed position to form a seal, the lid being attached to the dispenser body by a hinge; and a release mechanism having an activation portion and an engagement portion, wherein the entirety of the activation portion is positioned within an aperture in the sidewall, the engagement portion being positioned between the sidewall and the lip when the lid is in a closed position, the activation portion being configured to slide toward the base to release the lid and allow the dispenser to open.

2. The dispenser of claim 1, wherein the interior section comprises a first interior section and a second interior section, the first interior section configured to house the product, and the second interior section defining the opening and having an inner channel configured for the dispensing of product.

3. The dispenser of claim 2, wherein the engagement portion is positioned in the second interior section between the sidewall and the lip when the lid is in the closed position.

4. The dispenser of claim 1, wherein the release mechanism moves between a first position in which the engagement portion engages the lip to retain the lid in the closed position, and a second position in which the engagement portion is displaced from the lip to permit the lid to move into an opened position.

5. The dispenser of claim 4, wherein the second position is located downward with respect to the first position.

6. The dispenser of claim 4, wherein the release mechanism includes a spring, the spring configured to bias the release mechanism in the first position in which the engagement portion engages the interior portion of the lip.

7. The dispenser of claim 1, wherein the release mechanism includes sides that are separated from at least a portion the activation portion by one or more slots.

8. The dispenser of claim 1, wherein the activation portion includes a tab.

9. The dispenser of claim 1, wherein the dispenser body is formed as top piece and a bottom piece removably connected to the top piece.

10. The dispenser claim 9, wherein the bottom piece and the top piece comprise interlocking shoulders.

* * * * *